US008382105B2

(12) United States Patent
Compera et al.

(10) Patent No.: US 8,382,105 B2
(45) Date of Patent: Feb. 26, 2013

(54) DEVICE AND METHOD FOR THE ALIGNMENT OF SHEETS

(75) Inventors: Christian Compera, Schoenau (DE); Soenke Dehn, Daenischenhagen (DE); Ingo Neuber, Bornstein (DE)

(73) Assignee: Eastman Kodak Company, Rochester, NY (US)

( * ) Notice: Subject to any disclaimer, the term of this patent is extended or adjusted under 35 U.S.C. 154(b) by 0 days.

(21) Appl. No.: 13/120,512

(22) PCT Filed: Jul. 24, 2009

(86) PCT No.: PCT/EP2009/059581

§ 371 (c)(1), (2), (4) Date: Mar. 23, 2011

(87) PCT Pub. No.: WO2010/034540

PCT Pub. Date: Apr. 1, 2010

(65) Prior Publication Data

US 2011/0193286 A1 Aug. 11, 2011

(30) Foreign Application Priority Data

Sep. 24, 2008 (DE) ..... 10 2008 048 659

(51) Int. Cl.
*B65H 9/04* (2006.01)

(52) U.S. Cl. ..... 271/253; 271/272; 271/314

(58) Field of Classification Search ..... 271/228, 271/227, 253, 249, 272, 314
See application file for complete search history.

(56) References Cited

U.S. PATENT DOCUMENTS

| | | | | |
|---|---|---|---|---|
| 4,082,456 | A * | 4/1978 | Schroter | 355/109 |
| 5,234,208 | A * | 8/1993 | Bandura et al. | 271/34 |
| 5,322,273 | A | 6/1994 | Rapkin et al. | |
| 6,173,952 | B1 * | 1/2001 | Richards et al. | 271/228 |
| 2003/0059239 | A1 | 3/2003 | Shin | |

FOREIGN PATENT DOCUMENTS

| | | | |
|---|---|---|---|
| EP | 0 469 866 | | 2/1992 |
| JP | 04323135 A | * | 11/1992 |

* cited by examiner

*Primary Examiner* — Luis A Gonzalez
(74) *Attorney, Agent, or Firm* — Christopher J. White

(57) ABSTRACT

For a device for the alignment of sheets, which comprises at least one first and one second driving roller (20) and at least one pressure roller (21), as well as at least one first and one second rotary drive (26) for rotating said first and second driving rollers (20), respectively, about an axis of rotation (28), a simple and cost-effective setup is achieved by at least one displacement drive for shifting at least the driving rollers (20) along the axis of rotation in such a manner that there is a change of distance between the driving rollers.

18 Claims, 3 Drawing Sheets

DEVICE AND METHOD FOR THE ALIGNMENT OF SHEETS

TECHNICAL FIELD OF THE INVENTION

The present invention relates to a device and a method for the alignment of sheets for a printing machine.

BACKGROUND OF THE INVENTION

Printing machines for printing individual sheets can print sheets of different materials and of different sizes. Such printing machines for printing individual sheets comprise, as a rule upstream of at least one printing unit, a sheet-alignment unit. This sheet-alignment unit serves to exactly align supplied sheets with respect to the sheet transport path through the printing unit, before the sheets are passed on for printing or further processing. To accomplish this, the position of the supplied sheets is detected by sensors and forwarded to a control device. Usually, the control device controls various alignment rollers that align a misaligned sheet relative to the sheet transport path.

Known sheet-positioning arrangements comprise, for example, adjacent axially shiftable pairs of rollers that are capable of shifting a supplied sheet in a direction transverse to the sheet transport path (crosstrack alignment). Furthermore, sheet-alignment arrangements are known that comprise pairs of rollers transverse to the sheet transport path at a distance from each other, which pairs of rollers can be driven in different ways in order to align the lead edge of a supplied sheet in a direction perpendicular to the sheet transport path, before said sheets pass through the printing machine (angle or skew alignment).

The accuracy in determining and correcting a misalignment of a sheet depends on the distance of the alignment rollers from each other and on the sensors that are being used (skew sensors that measure the incoming lead edge of a sheet). For a rigid installation, the distance of the alignment rollers is determined by the smallest sheet width that is to be processed by the printing machine. The resolution of a potential angle adjustment of the sheet is highly dependent on the distance between the alignment rollers. At a small distance of the alignment rollers and with large sheet formats, an accurate angle adjustment of the sheet is not possible. A small distance of the alignment rollers primarily restricts the accuracy of the angle adjustment process. Therefore, it is desirable to adapt the distance between the alignment rollers to the width of the supplied sheet.

In most instances, known sheet-positioning and sheet-alignment arrangements are complicated because they, on the one hand, comprise pairs of rollers for positioning the sheet in a direction transverse to the sheet transport path through the machine and, on the other hand, comprise pairs of sheet alignment rollers for aligning the lead edge of a sheet in a direction perpendicular to the sheet transport path. EP 0 469 866 A also discloses an arrangement that performs a skew alignment and a crosstrack alignment by way of the same pairs of rollers. However, the moved masses are very large in crosstrack alignment. This is disadvantageous for a rapid adjustment of the pairs of rollers.

Other known arrangements have been disclosed in U.S. Pat. No. 5,322,273 and in publication DE 101 60 382. U.S. Pat. No. 5,322,273 discloses a complex device that, among other things, is suitable for a sheet alignment perpendicular to the sheet transport path (de-skewing). The rollers or segmented cylinders provided therefor comprise appropriate drives. DE 101 60 382 discloses driven support rollers that can be shifted in transverse direction by a spindle mechanism that is located on the inside.

SUMMARY OF THE INVENTION

It is the object of the present invention to provide a simple and cost-effective device for the alignment of sheets for a printing machine. The object of the invention is achieved by a device for the alignment of sheets, which comprises at least one first and one second driving roller and at least one pressure roller, as well as at least one first and one second rotary drive for rotating said first and second driving rollers, respectively, about an axis of rotation. Furthermore, at least one displacement drive is provided for shifting at least the driving rollers along the axis of rotation in such a manner that the distance between the driving rollers changes. As a result of this, a good resolution of the angle alignment of a sheet is achieved.

It is advantageous if the device for the alignment of sheets has a shared pressure roller for the first and second driving rollers because, as a result of this, a second pressure roller becomes unnecessary, and costs can be lowered. Alternatively, one pressure roller each may be provided for the first and the second driving rollers in order to achieve good adjustability of the rollers relative to each other and in order to avoid an axial relative movement between the rollers.

In the device for the alignment of sheets, preferably at least one pressure roller is fixed in position in the direction of the axis of rotation and has a width dimension that corresponds at least to the width of the driving roller plus a displacement path of the driving roller in the direction of the axis of rotation. With such a width dimension, no shifting of the pressure roller in the direction of the axis of rotation need be provided, and costs can be lowered.

Advantageously, in the device for the alignment of sheets, the driving rollers have a section displaying a reduced diameter in order to permit an unencumbered insertion of the sheet between the driving roller and the pressure roller.

In the device for the alignment of sheets, the driving rollers and the at least one pressure roller can preferably assume a first operative position, in which they are positioned radially adjacent to each other, and a second operative position, in which they are radially at a distance from each other. Consequently, a sheet guided between the rollers can be held firmly or released by said rollers.

The displacement drive of the device for the alignment of sheets is preferably connected with the driving rollers in order to directly control their displacement. Alternatively, the displacement drive is preferably connected to the driving rollers and their associate pressure rollers for their joint movement in the direction of the axis of rotation so as to achieve synchronous shifting.

The displacement drive preferably comprises a threaded spindle drive with counter-rotating threaded sections that are associated with each driving roller. As a result of this, it becomes possible to perform a precise high-resolution displacement in the direction of the axis of rotation. It is also possible for each driving roller to be associated with its own displacement drive with a threaded spindle drive in order to provide as many adjustment options as possible. Alternatively, the displacement drive may also comprise a cable pull mechanism in order to save weight and costs.

Advantageously, the driving roller is supported on its drive shaft so as to be shiftable in the direction of the axis of rotation because, as a result of this, the support of the drive shaft can be done in a stable manner and can be implemented with cost-effective components. Alternatively, the driving roller can also be fixed on its drive shaft in the direction of the axis of rotation, and it may be possible for the drive shaft to be shifted in the direction of the axis of rotation. As a result of this, any tilting and/or blocking of the driving roller during the displacement on its drive shaft can be avoided.

In one embodiment of the invention, the driving roller and/or the pressure roller are arranged in a roller support carriage that can be shifted in axial direction. In this way, a stable support of the rollers and the ability to shift them in the direction of their axis of rotation is achieved at the same time.

Furthermore, the object of the invention is achieved by a method for the alignment of a sheet for printing said sheet in a printing machine, wherein a sheet is transported along a sheet transport path to a sheet alignment device, which comprises one first and one second driving roller and at least one pressure roller, wherein a skewed position of the sheet is detected and wherein a distance between the first and second pressure rollers is adjusted in response to a width of the sheet. Subsequently, the sheet is grasped by the driving rollers and the at least one pressure roller, and the first and second driving rollers are individually rotated in order to compensate for a skewed position of the sheet. As a result of this, high accuracy is achieved regarding the correction of the skewed position of the sheet.

It may be advantageous to have sensors detect the width of the sheet in order to determine the optimal position of the rollers for the supplied sheet. Alternatively, the width of the sheet may also be prespecified by a control device of the printing machine, as a result of which additional sensors may be omitted.

Preferably, the method for the alignment of a sheet also comprises the adjustment of the distance of two pressure rollers corresponding to the distance of the driving rollers in order to achieve good abutment pressure and an alignment of the rollers relative to each other.

Advantageously, a lateral deviation of the current position (actual position) of the sheet from a desired position (setpoint) is also detected with this method, and the sheet, if it is grasped between the driving rollers and the at least one pressure roller, is shifted in parallel direction by the driving rollers in the direction of said driving rollers' axis of rotation as a function of the lateral deviation. As a result of this, a transverse alignment of the sheet relative to the intended sheet transport path is achieved.

Furthermore, the method preferably comprises the parallel shifting of the pressure rollers in the direction of the axis of rotation corresponding to the shifting of the driving rollers in order to achieve good abutment pressure and alignment of the rollers relative to each other.

BRIEF DESCRIPTION OF THE DRAWINGS

The drawings show in

DETAILED DESCRIPTION OF THE INVENTION

Figure 1:
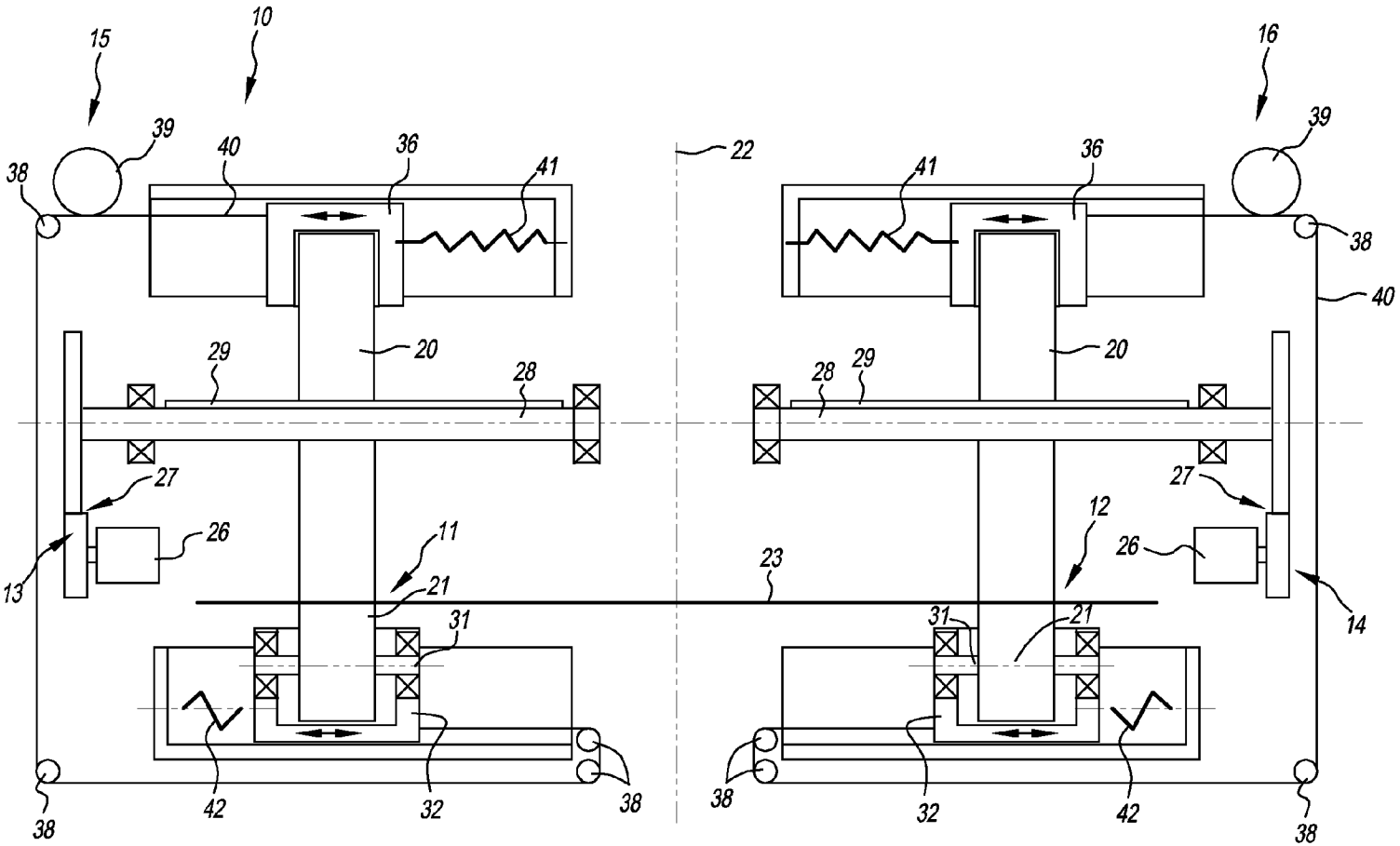
FIG. 1 a schematic front view of a device for the alignment of sheets for a printing machine in accordance with a first embodiment of the present invention, i.e., viewed in transport direction of a sheet.

In the description hereinafter, the terms right, left, top and bottom, and similar terms, refer to the shown figures and should not be understood to have any restrictive meaning. It will be obvious to the person skilled in the art that the depicted components may also be arranged in a different alignment. The devices for the alignment of sheets for a printing machine as shown in FIGS. 1 and 2 are depicted in such a manner that a passing sheet would be moved into the plane as shown in the drawings.

Figure 2:
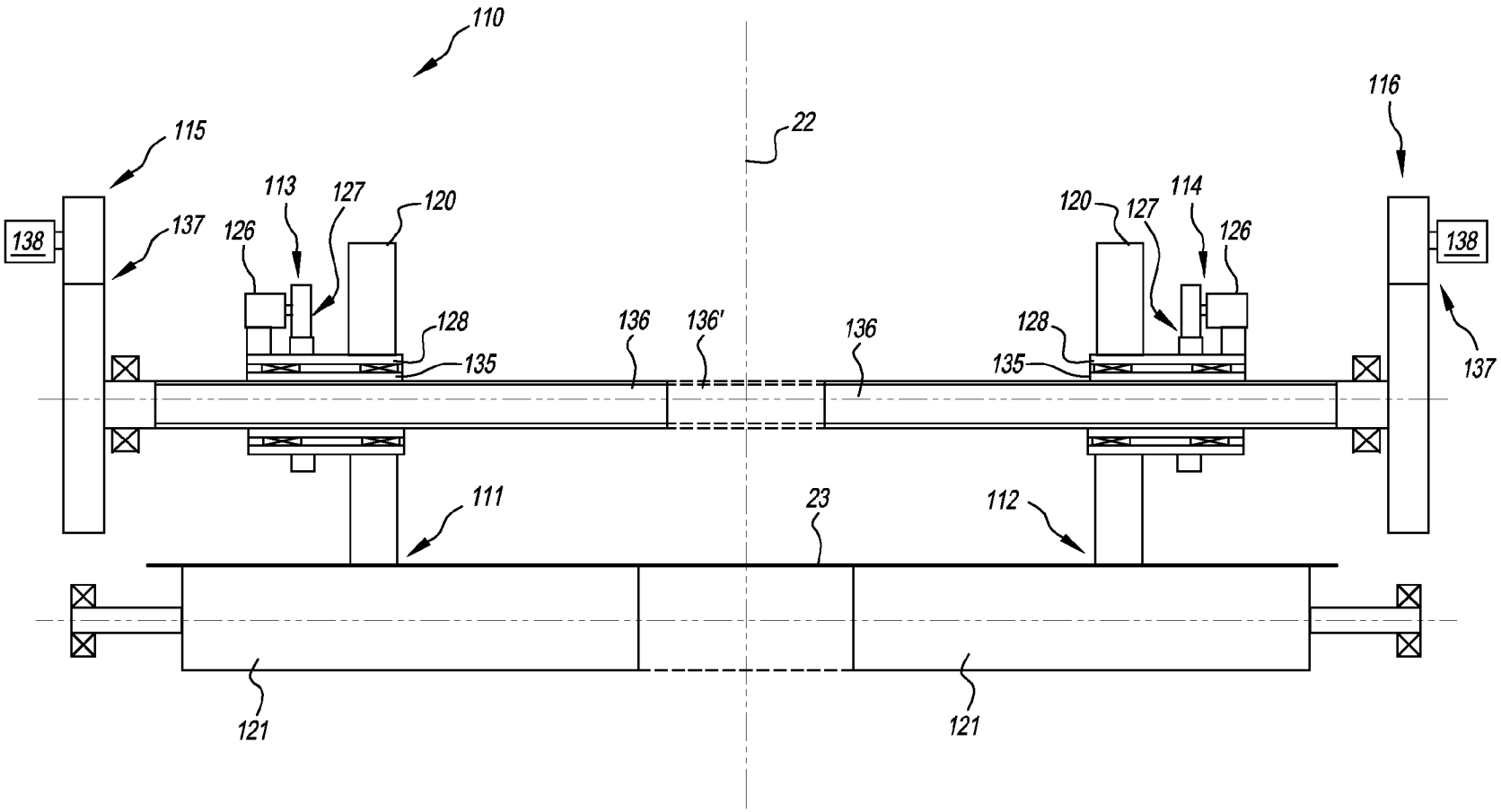
FIG. 2 a schematic front view of a device for the alignment of sheets for a printing machine in accordance with a second embodiment of the present invention, i.e., viewed in transport direction of a sheet.

FIG. 1 shows a first embodiment of a device 10 for the alignment of sheets to be printed by a not illustrated printing machine, said device 10 comprising a left roller pair 11 and a right roller pair 12 having axes of rotation parallel to each other. The device 10 comprises a left rotary drive 13 and a right rotary drive 14 for driving the roller pairs 11, 12 about their axes of rotation. In addition, the device 10 comprises a left displacement drive 15 and a right displacement drive 16 for shifting the roller pairs 11, 12 in the direction of the axis of rotation. Furthermore, a not illustrated control device is provided for the control of the rotary drives 13, 14 and the displacement drives 15, 16. The control device may also be an integral part of a general control device for the control of other functions of the printing machine.

Figure 3A:
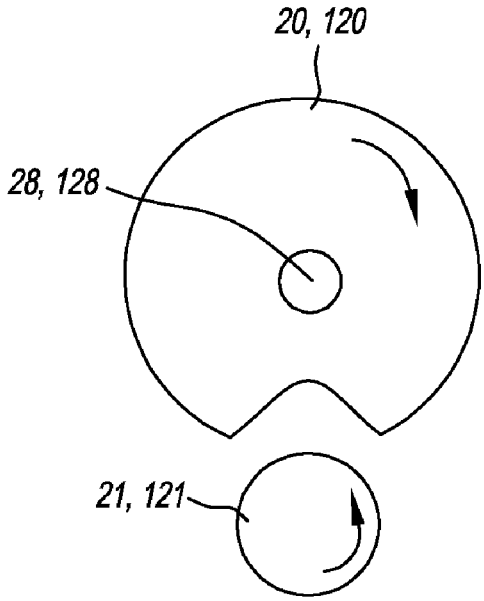
FIGS. 3*a, b* respectively, a schematic side view of a driving roller and a pressure roller of a device for the alignment of sheets for a printing machine, in various positions.
Figure 3B:
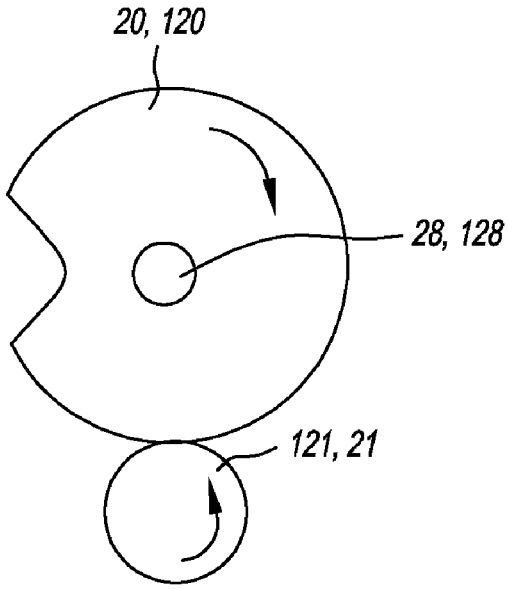

Each roller pair 11, 12 comprises one driving roller and one pressure roller 21, said rollers being positioned opposite each other and being in peripheral contact over a prespecified rotation section of the driving roller 20 (FIG. 3*a*). On its circumference, the driving roller 20 has a section or a segment displaying a reduced diameter, so that the pressure roller 21 and the driving roller 20 are not in contact with each other when the reduced-diameter section of the driving roller 20 faces toward the pressure roller 21 (FIG. 3*b*). In their basic position, the roller pairs 11, 12 are arranged symmetrically with respect to a central axis 22 of a sheet transport path through the printing machine, although an asymmetrical alignment is also possible.

A sheet 23 consisting of paper, for example, that should preferably be aligned symmetrically and at a right angle relative to the central axis 22 is held between the roller pairs 11, 12. However, if the section of the driving roller 20 displaying the reduced diameter is arranged opposite of its associate pressure roller 21, the sheet 23 can be freely moved between the driving roller 20 and the pressure roller 21.

Each of the left and the right rotary drives 13, 14 for the left and the right roller pairs 11, 12 comprises a rotary drive motor 26, an (optional) gearing 27 as well as a drive shaft 28 on which the driving rollers 20 are arranged. The rotary drive motor 26 is preferably a stepper motor, and the gearing 27 is, for example, a spur gearing.

The driving rollers 20 are arranged on their drive shaft 28 in a torque-proof but axially shiftable manner. This torque-proof connection of a driving roller 20 and its drive shaft 28 may comprise, for example, a fitting key, a spline shaft or similar shaft/hub connections, with a fitting key 29 being shown in FIG. 1. The pressure rollers 21 are arranged on a carrier axle 31 that is supported in a roller support carriage 32 that can be shifted toward the right and toward the left. The pressure roller 21 is resiliently supported relative to the driving roller 20 in order to be able to accommodate sheets 23 having different thicknesses.

The left and the right displacement drives 15, 16 comprise a follower 36 that is connected with the driving roller 20. The follower 36 has a U-shaped recess having an inside width corresponding to the width of the driving roller 20 plus a minimal play. The lateral surfaces of the driving roller and/or the inside lateral surfaces of the U-shaped recess comprise a material that has a low coefficient of friction, for example, Teflon. Consequently, the driving roller 20 can rotate freely in the U-shaped recess of the follower 36. The follower 36 is supported so that it can be shifted, perpendicularly to the central axis 22, toward the right and toward the left in the direction of the axis of rotation.

Furthermore, the displacement drive 15, 16 comprises several additional deflecting rollers 38, an adjustment roller 39 and a traction cable 40. The adjustment roller 39 is connected to a not illustrated adjustment roller motor. The axes of rotation of the deflecting rollers 38 and the adjustment roller 39 extend parallel to the central axis 22.

The traction cable 40 extends from the follower 36 around the adjustment roller 39, is deflected by the deflecting rollers 38, and is finally connected to the roller support carriage 32. The traction cable 40 is completely passed around the adjustment roller 39 in order to improve a power transmission by friction. Furthermore, the traction cable 40 is maintained tensioned by a first tension spring 41 between the follower 36 and a fixed anchor on the housing of the printing machine, and by a second tension spring 42 that is tensioned between the roller support carriage 32 and the housing of the printing machine.

During operation of the roller adjustment arrangement 10 of the first embodiment, a sheet 32 is first supplied in the direction of the central axis 22 of the printing machine. Lateral sensors (crosstrack sensors) not illustrated measure the width and the arrangement of the sheet 23 relative to the central axis 22. Likewise, alignment sensors (skew sensors) not illustrated measure the alignment or angular inclination of the lead edge of the sheet 23 relative to the central axis 22.

The distance of the roller pairs 11, 12 is adapted to different sheet widths in that the roller pairs 11, 12 are moved by their respective displacement drives 15, 16 in opposing directions. They may be moved away from each other in outward direction in order to be able to accommodate large sheets 23. Likewise, small sheets 23 can be grasped by the roller pairs 11, 12 when the roller pairs 11, 12 are moved by their respective displacement drives 15, 16 toward each other in inward direction.

The displacement operation explained hereinafter describes the displacement of the right roller pair 12 in the direction of the axis of rotation toward the right. The displacement operation works in reverse direction with an adjustment of the right roller pair 12 toward the left, in which case the displacement roller 39 is then driven in clockwise direction. Analogously, a displacement operation of the left roller pair 11 toward the right and left occurs in the direction of the axis of rotation.

In order to displace the driving roller 20 of the right roller pair 12 in the direction of the axis of rotation to the right, the adjustment roller 39 of the right rotary drive 16 is rotated in counterclockwise direction. As a result of this, the traction cable 40 is moved to the right and pulls the follower 36 against the pull of the tension spring 41 to the right. At the same time, the part of the traction cable 40 between the adjustment roller 39 and the roller support carriage 32 is relaxed, the tension spring 42 pulling the roller support carriage 32 also to the right. The length by which the traction cable 40 is wound onto the adjustment roller 39—and thus the distance by which the follower 36 is moved to the right—is unwound, at the same time, from the other side of the adjustment roller 39. Consequently, the follower 36 and the roller support carriage 32 are moving in parallel (i.e., by the same distance) to the right.

Hereinafter, the expression "parallel displacement" is used to mean that a displacement of the left and right rollers or roller pairs by respectively the same distance in the direction of the axis of rotation occurs toward the left or toward the right. When the distance of the rollers or roller pairs changes, said rollers or roller pairs move together toward each other or away from each other in the direction of the axis of rotation.

If the lead edge of the sheet 23 is not perpendicular to the central axis 22, the size of the angular deviation is measured by the alignment sensors and transmitted to the control device. Said control device individually controls the appropriate rotary drives 13 or 14 of the driving rollers 20 in a manner known per se, until the lead edge of the sheet 23 is aligned perpendicular to the central axis 22.

This may be achieved, for example, in that the roller pairs 11, 12 grasp the sheet 23 respectively at the same distance from the lead edge of the sheet 23 and are then driven by their respective rotary drive 13 or 14 either faster or more slowly in order to compensate for an inclined position of the sheet 23 and, at the same time, release said sheet.

Unless the sheet 23 is aligned symmetrically with respect to the central axis 22, the degree of the deviation from the central position is measured by the lateral sensors and transmitted to the control device. While the sheet 23 is being grasped by the roller pairs 11, 12 (for example, position as in FIG. 3*b*), said sheet is moved in parallel direction by said roller pairs by means of the right and left displacement drives 15, 16 out of the central position toward the left or toward the right. As a result of this, the deviation of the sheet 23 from the central position is minimized or eliminated.

FIG. 2 shows another embodiment of a device 110 for the alignment of sheets in accordance with a second embodiment of the present invention. The device 110 comprises a left roller pair 111, a right roller pair 112, a left rotary drive 113, a right rotary drive 114, as well as a left displacement drive 115 and a right displacement drive 116.

Each of the left and the right roller pairs 111, 112 comprises a driving roller 120 and a pressure roller 121, said rollers being located opposite each other. As in the first embodiment, the driving rollers 120 have a section or a segment displaying a reduced diameter. In a position, in which the section displaying the reduced diameter is located opposite the pressure roller 121, a sheet 23 can be freely moved between the driving roller 120 and the pressure roller 121 (see also FIG. 3*a*). The pressure rollers 121 are arranged opposite the corresponding driving roller 120 and have a width that corresponds at least to the width of the driving roller plus a prespecified displacement path of the driving roller 120 in the direction of the axis of rotation.

The left rotary drive 113 and the right rotary drive 114 are set up symmetrically so that only one side will be described here. The description may be applied, laterally reversed, to the other side. Each of the left and the right rotary drives 113, 114 comprises a rotary drive motor 126, a gearing 127 and a hollow drive shaft 128 that support the driving roller 120 in a fixed, torque-free and axially rigid manner.

The left and the right displacement drives 115, 116 are also arranged symmetrically and the description of one side may be applied, laterally reversed, to the description of the other side, Hereinafter, the right displacement drive 116 will be explained.

The right displacement drive 116 comprises a spindle nut 135 that is arranged inside the hollow drive shaft 128 and can be rotated relative to said drive shaft, and comprises a threaded spindle 136. The threaded spindle 136 extends through the spindle nut 135 and is connected to a displacement motor 138 via an optional gearing 137. The spindle nut 135 is connected in a torque-free but axially shiftable manner with the housing of the printing machine. The hollow drive shaft 128 can be freely rotated relative to the spindle nut 135 but cannot be shifted axially in the direction of the axis of rotation in a manner relative to said axis of rotation.

A rotation of the displacement motor 138 drives the threaded spindle 136 via the optional gearing 137. The spindle nut 135 moves, depending on the direction of rotation of the threaded spindle 136, toward the right or toward the left. This means that the drive shaft 128 follows an axial movement of the spindle nut 135 toward the right or toward the left in the direction of the axis of rotation.

Alternatively, it is also possible to provide only one displacement motor 138 that is connected, via at least one gearing, with the two displacement drives 115, 116. The gearing may be reversible in order to achieve a corotational or counter-rotational rotation of the respective threaded spindles. As a result of this, only one displacement motor 138 is necessary to provide a parallel shifting of the rollers in a direction transverse to the sheet transport path, on the one hand, and to provide a distance change of the rollers, on the other hand. Alternatively, the gearing may not be reversible and permit either a parallel shifting of the rollers in a direction transverse to the sheet transport path or permit a distance change of the rollers. This embodiment offers the advantage that the lateral displacement of the rollers by the gearing is always synchronous, and that the right and left displacement motors 138 need not be driven synchronously with respect to each other.

An angular deviation of a supplied sheet 23 may be compensated for as in the first embodiment. Said deviation works analogously to the description above and will thus not be explained again at this point.

In the embodiment in accordance with FIG. 2, too, an adaptation of the roller distance to the width of the sheet 23 is possible, and the driving rollers 120 can be shifted relative to the central axis 22 in the direction of the axis of rotation in an inward or outward direction.

Different from the embodiment in accordance with FIG. 1, the distance change of the driving rollers 120 is accomplished in that the threaded spindles 136 of the right and left displacement drives 115, 116 are rotated by the displacement motors 138. The spindle nuts 135 and the driving rollers 120 of the right and left roller pairs 111, 112 connected therewith are shifted toward each other or away from each other in order to grasp large or small sheets 23.

The pressure roller 121 is not shifted in the direction of the axis of rotation because it has a width such that the driving roller 120 will move on said pressure roller in any position. This means that in the second embodiment only the driving rollers 120 are shifted corresponding to the width of the sheet 23. Like in the first embodiment, the driving roller 120 and the pressure roller 121 are supported so as to be resilient relative to each other in order to be able to accept sheets 23 having different thicknesses.

In the case of the embodiment in accordance with FIG. 2, a parallel, lateral displacement of the sheet 23 is also possible if a misalignment of a supplied sheet 23 relative to the central axis 22 is being detected. Then, the driving rollers 120 grasp the sheet 23 and can be shifted, parallel together with said sheet, relative to the central axis 22 in the direction of the axis of rotation toward the right or toward the left.

The parallel lateral displacement of the driving rollers 120 is accomplished in that the threaded spindles 136 of the right and left displacement drives 115, 116 are rotated correspondingly by the displacement motors 138. The spindle nuts 135 and the driving rollers 120 of the right and left roller pairs 111, 112 connected therewith are shifted parallel toward the right or toward the left in order to minimize or eliminate the misalignment of a supplied sheet 23 relative to the central axis 22.

Additional combinations of the depicted components are conceivable. For example, it is possible to use the wide pressure roller 121 of the second embodiment (FIG. 2) in the first embodiment (FIG. 1), whereby the lateral displacement of the pressure roller 21 may then be omitted. In this case, the displacement drive for the driving roller 20 comprises only the tension spring 41, the follower 36, the traction cable 40 and the adjustment roller 39. Alternatively, in the second embodiment, it is possible to provide shiftable pressure rollers with drives that correspond, for example, to the displacement drives 115, 116.

Another modification of the pressure roller 121 that can be used in both embodiments is a pressure roller 121 that essentially extends across the entire width of the sheet transport path and supports the sheet 23 across the entire width. Consequently, only one wide pressure roller or pressure cylinder 121 would be required for the two sides.

In the second embodiment of FIG. 2, it would be possible to provide only one displacement drive 115 or 116. In this instance, the threaded spindles 136 of the left and right displacement drives 115, 116 in FIG. 2 would be connected in the center. Such a continuous shared threaded spindle 136' then has a region with a left-hand thread and a region with a right-hand thread. During a rotation of the threaded spindle 136', the left and right roller pairs 111, 112 are either shifted toward each other or away from each other. With a displacement of the shared threaded spindle 136' by a corresponding displacement unit, it would then be possible to perform a lateral shift or crosstrack shift, if necessary.

Furthermore, it is possible to fix the driving roller 20 in position on its drive shaft 28 so as to be torque-proof and axially rigid, in which case the respective drive shaft 28 is shifted in its support in the housing of the printing machine when a lateral displacement of the roller pairs 11, 12 occurs.

The invention has been described with reference to preferred embodiments, wherein the individual features of the described embodiments may be freely combined and/or interchanged with each other, provided that they are compatible. Numerous modifications and forms are possible for and obvious to the person skilled in the art, without departing from the inventive idea as a result of this.

The invention claimed is:

1. A device for the alignment of sheets, the device comprising:

at least one first and at least one second driving roller and a shared pressure roller for the first and the second driving rollers;

at least one first and at least one second rotary drive for rotating the first and second driving rollers about an axis of rotation; and at least one displacement drive for shifting at least the driving rollers along the axis of rotation in such a manner that there is a change of distance between the driving rollers.

2. The device according to claim 1, wherein each of the driving rollers includes a respective section displaying a reduced diameter.

3. The device according to claim 1, wherein the at least one displacement drive includes a threaded spindle drive having respective counter-rotating threaded sections associated with each driving roller.

4. The device according to claim 1, wherein each driving roller is associated with a respective displacement drive having a threaded spindle drive.

5. The device according to claim 1, wherein the driving roller is supported on its drive shaft and is shiftable in the direction of the axis of rotation.

6. The device according to claim 1, wherein the driving roller is fixed in position on its drive shaft in the direction of the axis of rotation, and the drive shaft is shiftable in the direction of the axis of rotation.

7. A method for aligning a sheet for printing the sheet in a printing machine, the method comprising:

transporting a sheet along a sheet transport path to a sheet alignment device having a first and a second driving roller and at least one pressure roller;

detecting an inclined position of the sheet;

adjusting a distance transverse to the sheet transport path between the first and the second driving rollers in response to a width of the sheet;

grasping the sheet between the driving rollers and the at least one pressure roller; and individually rotating the first and the second driving rollers in order to compensate for an inclined position of the sheet, so that the sheet is aligned for printing.

8. The method according to claim 7, further comprising detecting the width of the sheet using a sensor.

9. The method according to claim 7, further comprising receiving a prespecified width of the sheet using a control device of the printing machine.

10. The method according to claim 7, further comprising adjusting the distance of two pressure rollers corresponding to the distance of the driving rollers.

11. The method according to claim 7, further comprising:

detecting a lateral deviation of the current position of the sheet from a desired position of the sheet;

grasping the sheet between the driving rollers and the at least one pressure roller; and shifting the sheet in a parallel direction by moving the driving rollers in the direction of their axis of rotation as a function of the lateral deviation.

12. The method according to claim 11, further comprising moving the pressure rollers with the driving rollers.

13. A device for the alignment of sheets, the device comprising:

at least one first and at least one second driving roller, and a pressure roller for each of the first and the second driving rollers;

at least one first and at least one second rotary drive for rotating the first and second driving rollers about an axis of rotation; and at least one displacement drive for shifting at least the driving rollers along the axis of rotation in such a manner that there is a change of distance between the driving rollers, wherein each pressure roller is fixed in position in the direction of the axis of rotation and has a width dimension that corresponds at least to the width of the respective driving roller plus a displacement path of the respective driving roller in the direction of the axis of rotation.

14. The device according to claim 13, wherein the at least one displacement drive is connected to the driving rollers.

15. The device according to claim 13, wherein the at least one displacement drive is connected to the driving rollers and their associated pressure rollers for their joint movement in the direction of the axis of rotation.

16. A device for the alignment of sheets, the device comprising:

at least one first and at least one second driving roller and at least one pressure roller;

at least one first and at least one second rotary drive for rotating the first and second driving rollers about an axis of rotation; and at least one displacement drive for shifting at least the driving rollers along the axis of rotation in such a manner that there is a change of distance between the driving rollers, wherein the displacement drive includes a cable pull mechanism.

17. The device according to claim 16, wherein the driving rollers and the at least one pressure roller are movable between a first operative position in which they are positioned radially adjacent to each other, and a second operative position in which they are radially at a distance from each other.

18. The device according to claim 16, wherein the at least one first and the at least one second driving roller or the at least one pressure roller is arranged in a roller support carriage that can be shifted in axial direction.

* * * * *